US011052417B2

(12) United States Patent
Hentschel et al.

(10) Patent No.: US 11,052,417 B2
(45) Date of Patent: Jul. 6, 2021

(54) CLEANING STATION FOR NEEDLE NOZZLES

(71) Applicant: NORDSON CORPORATION, Westlake, OH (US)

(72) Inventors: Lothar Hentschel, Taufkirchen (DE); Semen Lerner, Munich (DE)

(73) Assignee: Nordson Corporation, Westlake, OH (US)

( * ) Notice: Subject to any disclaimer, the term of this patent is extended or adjusted under 35 U.S.C. 154(b) by 413 days.

(21) Appl. No.: 15/765,564

(22) PCT Filed: Oct. 4, 2016

(86) PCT No.: PCT/US2016/055289

§ 371 (c)(1),
(2) Date: Apr. 3, 2018

(87) PCT Pub. No.: WO2017/062342

PCT Pub. Date: Apr. 13, 2017

(65) Prior Publication Data

US 2019/0076871 A1 Mar. 14, 2019

(30) Foreign Application Priority Data

Oct. 6, 2015 (DE) ..... 20 2015 105 290.1

(51) Int. Cl.

| | |
|---|---|
| ***B05B 15/555*** | (2018.01) |
| ***B05B 1/00*** | (2006.01) |
| ***B05C 5/02*** | (2006.01) |

(52) U.S. Cl.

CPC ..... *B05B 15/555* (2018.02); *B05B 1/005* (2013.01); *B05C 5/02* (2013.01); *B05C 5/0225* (2013.01)

(58) Field of Classification Search

CPC ..... B05B 15/555; B05B 1/005; B05C 5/02; B05C 5/0225; B01D 35/02

See application file for complete search history.

(56) References Cited

U.S. PATENT DOCUMENTS

| | | | |
|---|---|---|---|
| 3,771,539 | A | 11/1973 | De Santis |
| 4,934,393 | A | 6/1990 | Lighthall et al. |
| 2014/0283878 | A1 | 9/2014 | Ooshiro et al. |

FOREIGN PATENT DOCUMENTS

| | | | |
|---|---|---|---|
| CN | 202 081 329 | U | 12/2011 |
| DE | 103 04 836 | A1 | 8/2004 |
| DE | 102005051224 | A1 | 5/2007 |

(Continued)

OTHER PUBLICATIONS

International Patent Application No. PCT/US2016/055289; Int'l Preliminary Report on Patentability; dated Apr. 19, 2018; 11 pages.

*Primary Examiner* — David Redding
(74) *Attorney, Agent, or Firm* — Baker & Hostetler

(57) ABSTRACT

A cleaning apparatus for cleaning a nozzle of a liquid dispensing device is disclosed. The cleaning apparatus includes a base member supporting a receiving head including a receiving opening for receiving a portion of the nozzle to be cleaned, a gas inlet for receiving pressurized gas, and an outlet at the receiving head for applying pressurized gas to the nozzle for flushing the nozzle. The receiving opening can include a sealing edge for sealing the receiving head against the nozzle when the nozzle is received in the receiving opening. The cleaning apparatus can also include at least one of a discharge tube, a collection vessel and a filter element.

18 Claims, 4 Drawing Sheets

(56) References Cited

FOREIGN PATENT DOCUMENTS

| | | | |
|---|---|---|---|
| DE | 10 2007 031555 | A1 | 1/2009 |
| DE | 102014104849 | A1 | 10/2014 |
| GB | 2 198 033 | A | 6/1988 |
| JP | 63-123457 | A | 5/1988 |
| JP | H09-262518 | A | 10/1997 |
| JP | 2007-216191 | A | 8/2007 |
| JP | 2014-184357 | A | 10/2014 |
| JP | 2014-188448 | A | 10/2014 |
| WO | 2007/048816 | A1 | 5/2007 |

CLEANING STATION FOR NEEDLE NOZZLES

CROSS-REFERENCE TO RELATED APPLICATIONS

This application is a National Stage of International Patent Application No. PCT/US2016/055289, filed Oct. 4, 2016, which claims priority to German Patent Application No. DE 20 2015 105 290.1, filed Oct. 6, 2015, the disclosures of which are incorporated by reference in their entirety.

FIELD OF THE INVENTION

The invention relates to a cleaning apparatus for cleaning a nozzle of a liquid dispensing device, comprising a base member supporting a receiving head comprising a receiving opening for receiving a portion of the nozzle to be cleaned, a gas inlet for receiving pressurized gas, and a gas channel having an outlet at the receiving head for applying pressurized gas to the nozzle for flushing the nozzle.

BACKGROUND

When dispensing liquids, in particular such as adhesives, hot melt adhesives, lubricants or the like, which are high viscous, it can happen that residues of the fluids accumulate in the area of the nozzle orifice, leading to an undesired application pattern on the substrate and clogging of the nozzle. For ensuring an even application process with replicable application results, it is common to clean the nozzle, either on demand, or in predetermined intervals to remove the liquid residues adhered to the nozzle tip.

From DE 10 2005 051 224 A1, a device is known, which is being attached to the nozzle and flushes the nozzle opening permanently during operation of the nozzle with gas, for a cleaning of residual fluid. The device comprises a body, for clamping the device against the end portion of the nozzle, and a through hole, which is aligned with the nozzle orifice, so that the discharged liquid can travel there through. The device furthermore comprises gas channels which are arranged in the area of the nozzle opening and which are connected to a vacuum source, so that the residual fluid at the nozzle orifice is being drawn away. However, drawing has showed to be not effective enough to have a proper cleaning result. The disclosed device on the other hand is also able to blow away the residual fluids by means of an overpressure source, however, the blown off liquid particles will pollute the surrounding of the nozzle and may block the drain channels of the device.

Moreover a cleaning apparatus sold by Infotech AG, Switzerland is known. The cleaning apparatus comprises a cup shaped container and a cleaning head. The cleaning head is seated above the opening of the container and held in place by means of a plurality of magnets. The cleaning head has a substantially rectangular shape such that gaps are provided between the cleaning head and the upper rim of the container. The cleaning head comprises a through hole for receiving the tip of a needle nozzle. The through hole has a tapered inlet portion and a substantially cylindrical portion extending from the tapered portion. In the cylindrical portion a ring shaped purge air outlet is provided. The ring shaped outlet is connected with a frustroconical purge air conduit tapering downwards, in the same direction as the needle. In operation the purge air exiting the outlet forms a conical stream downwards the nozzle tip thus inducing a negative pressure at the nozzle tip. This negative pressure draws residual fluid from the nozzle tip into the container. Again, drawing has showed to be not effective enough to have a proper cleaning result.

It is an object of the invention to provide a cleaning apparatus which is improved with regard to at least one of the above-mentioned drawbacks.

SUMMARY OF THE INVENTION

The invention solves the above problem with a cleaning apparatus of the above mentioned type, in that the receiving opening comprises a sealing edge for sealing the receiving head against the nozzle when the nozzle is received in the receiving opening, wherein the outlet is adjacent the sealing edge. The cleaning apparatus of the present invention is not mounted against the nozzle permanently, but is a standalone device which might be positioned adjacent or in the neighborhood of a liquid dispensing device having a nozzle. The dispensing device may be moved to the cleaning apparatus or the cleaning apparatus may be moved to the nozzle. This can be carried out manually, or by means of a robot arm. The receiving head is adapted to receive the nozzle and comprises the receiving opening for receiving a portion of the nozzle, preferably the nozzle tip which is to be cleaned. When the nozzle is received in the receiving opening the nozzle comes into contact with the sealing edge and the environment is thus sealed against the nozzle tip. When the pressurized gas is applied to the nozzle tip, cleaned off particles will remain within the receiving head and not pollute the nozzle, the dispensing device or the substrate on which the liquid shall be dispensed. The nozzle itself remains free of any additional permanently mounted cleaning elements and can be used normally. The outlet is preferably adjacent the sealing edge, i.e. in close relation to the sealing edge. Needle nozzle may have a very shot nozzle tip, e.g. in the range of 2 mm to 5 mm or even less. According to the invention, the nozzle tip is purged by means of the pressurized gas and thus the pressurized gas is directly projected on the nozzle tip. To allow this cleaning action the outlet is arranged adjacent the sealing edge. Preferably a distance between the sealing edge and the outlet is in the range of 0.1 mm to 2 mm, preferably 0.1 mm to 1 mm, 0.1 mm to 0.9 mm or 0.8 mm or 0.7 mm, or 0.6 mm, or 0.5 mm.

According to a first preferred embodiment or another aspect of the invention the receiving head is movable for a first position to a second position upon contact with the nozzle, wherein upon movement of the receiving head from the first into the second position the gas inlet and the gas outlet are in gas communication for supplying gas from the gas inlet to the gas outlet. The gas inlet preferably is provided at the base member. When the receiving head is moved from a first position to a second position, the gas inlet of the cleaning apparatus, which is arranged at the base member, and the gas outlet of the cleaning apparatus, which is arranged at the receiving head, are set into communication, thus resulting in a flow off gas flowing from the gas inlet to the gas outlet and out of the gas outlet for impinging the nozzle, which is received in the receiving head. Therefore, a simple cleaning apparatus is provided, which can be used to clean off residues adhered at a nozzle tip on demand or at predetermined intervals, by bringing into contact the nozzle and the receiving head of the cleaning apparatus, and pushing the nozzle against the cleaning head or vice versa. It is not necessary to mount the whole device against the nozzle, as it is known from DE 10 2005 051 224 and the device can be used for a plurality of nozzles.

According to a further preferred embodiment, the receiving head is movable against a biasing force. The biasing force preferably acts such that the receiving head is biased into the first position, in which the gas inlet and the gas outlet are not in gas communication. Thus, the cleaning apparatus in idle state does not discharge gas. Gas is only discharged through the gas outlet, when the biasing force is overcome and the receiving head is pushed into the second position. A further advantage is that the nozzle is protected against overload due to a contact with the receiving head. The chance that an operator pushes the nozzle against the receiving head with an excess force is reduced due to the biasing means. Preferably, the cleaning apparatus therefore comprises biasing means for biasing the receiving head in the first position. The biasing means preferably comprise at least one coil spring, preferably at least two, three or four coil springs and/or at least one gas pressure cavity forming a pneumatic spring. A pneumatic spring is preferred, since the device is provided with pressurized gas for cleaning the nozzle. The pressurized gas may in addition be used to supply the pneumatic spring.

According to a further preferred embodiment, the cleaning apparatus comprises a shut-off valve between the gas inlet and the gas outlet. The shut-off valve preferably is closed in the first position of the receiving head and opened in the second position of the receiving head. Such a shut-off valve is a simple way to provide a closure between the gas inlet and the gas outlet and to set the gas inlet and the gas outlet into gas communication, when the receiving head is in the second position. Preferably, the shut-off valve comprises in an embodiment a blocking portion of the base member and a gas conduit formed in the receiving head, which are movable with respect to each other. In the first position the blocking portion blocks the conduit, and being moved out of the gas conduit, thus constituting a gas communication, when the receiving head is moved to the second position.

Furthermore, it is preferred that the gas channel is formed such that the gas is applied in a substantially radial direction to the nozzle. This helps to flush or purge the nozzle and to clean off residual liquid in effective manner. The gas flows radially from the outside to the inside and contacts the nozzle, so that substantially all residual liquid is purged off and the nozzle is cleaned. In an alternative the gas channel is formed such that the exiting gas swirls around the nozzle. It has however shown that a radial stream is more effective in cleaning the nozzle.

Moreover, the gas channel is preferably formed as a circumferential slot around the receiving opening. The gas channel is preferable ring shaped. This results in the gas being projected from the circumferential slot to the nozzle, thus from all radial sides, which results in a good cleaning result. The slot might be formed continuously, or discontinuously, while continuously is preferred.

In a preferred development or another aspect of the invention the gas channel is formed as a laval nozzle. The gas channel thus comprises a narrowed neck portion and widens to its outlet. A laval nozzle is able to accelerate the gas up to a supersonic velocity. The cleaning action is very effective.

According to a further preferred embodiment the gas channel has at least one tapered surface such that the gas channel flares open to the direction of the receiving opening. The flow of gas radially from outside to the inside preferably describes a conical shape for providing a flow of gas downstream the nozzle. Due to such an arrangement, the nozzle can be effectively cleaned.

According to a further preferred embodiment, the receiving head comprises a discharge channel for discharging cleaned off residual fluid. When the residual fluid has been cleaned off, it is preferred to discharge these particles, so that neither the gas outlet nor the nozzle is again contaminated with the liquid. The discharge channel preferably is formed adjacent to the receiving opening, in particular the receiving opening opens into the discharge channel. Therefore, the cleaned off residual liquid is directly pushed into the discharge channel and discharged.

Furthermore, it is preferred that the receiving head comprises a gas inlet, which is in gas communication with a gas inlet of the apparatus when the receiving head is in the second position, wherein the gas inlet of the receiving head leads to a substantially cylindrical space formed outside of the discharge channel and leading to the gas channel. This is a very simple and less space consuming way to form the circumferential slot in a continuous manner. The gas is first led into the cylindrical space, formed around and preferably coaxially to the discharge channel, then flowing to the gas channel and out of the outlet of the gas channel into the direction of the nozzle to be cleaned.

Furthermore, it is preferred that the cylindrical space is formed between first and second body parts of the receiving head which are fixed together, preferably screwed together. When forming the cylindrical space between first and second separate body parts which are being screwed together, these parts can be manufactured separately, which results in lower manufacturing costs and the cleaning apparatus is simple with respect to maintenance issues.

In a preferred embodiment or another aspect of the invention the apparatus comprises a removable nut defining the receiving opening with the sealing edge. Preferably the nut covers the cylindrical space and form a surface of the gas outlet. The nut is screwable against the receiving head. Such a nut may easy be replaced in case the geometry of the nozzle to be cleaned has changed. Additionally, by means of a screwable nut, the size of the gas outlet may be adjusted thus resulting in adjusting the gas stream against the nozzle.

According to a particular preferred embodiment, the discharge channel is provided with a discharge tube for lining an inner wall of the discharge channel. The discharge tube thus covers the surface of the discharge channel of the receiving head and cleaned off fluid residues are being prevented from contacting the surface of parts of the receiving head, thus simplifying the cleaning apparatus with respective maintenance and cleaning issues. The discharge tube preferably is formed as a disposable item. The discharge tube thus can be demounted from the cleaning apparatus and replaced by a new discharge tube, after a number of cleaning cycles. Therefore, the cleaning apparatus is easy to clean, namely in that the discharge tube is replaced by a new discharge tube, without the need of work intensive cleaning of single parts of the receiving head and/or the base member. The discharge tube may be formed of a plastic material, or of a material which adheres less to the liquid dispensed by the dispensing device, such as polytetrafluoroethylene (PTFE) or cardboard material. This helps to guide the liquid residues through the discharge channel.

According to a further preferred embodiment, the cleaning apparatus comprises a collection vessel for a collecting residual liquid cleaned from the nozzle. The collection vessel preferably is disposed adjacent to the discharge channel, such that residual liquid which travels through the discharge channel is being discharged into the collection vessel. The collection vessel preferably is formed as a disposable item. The collection vessel preferably is demountable from the cleaning apparatus without additional tools, preferably can be taken off manually and replaced by a new collection vessel. The collection vessel may be formed out of a plastic material, preferably the same material as the discharge tube, cardboard material or aluminium.

According to a further preferred embodiment the cleaning apparatus comprises a second gas outlet for discharging gas which has been used to flush the nozzle, wherein the second gas outlet is provided with a filter element for filtering the used gas exiting the apparatus. The gas travels first from the gas inlet of the cleaning apparatus to the gas outlet, impinging the nozzle for cleaning off residual liquids. After cleaning the nozzle, the gas preferably flows to the discharge channel and needs to exit the cleaning apparatus. Therefore, the cleaning apparatus comprises the second gas outlet. This gas outlet is provided with a filter element, such that the cleaned off residual liquid does not exit the cleaning apparatus, but remains inside. The filter element preferably is formed as a disposable item. The filter element preferably is demountable from the cleaning apparatus without any additional tools and preferably can be changed together with the collection vessel and/or the discharge tube. Therefore, cleaning and maintenance of the cleaning apparatus according to the invention is further simplified.

According to a second aspect of the invention, the problem stated in the introductory portion is solved by cleaning apparatus for cleaning a nozzle of a liquid dispensing device, comprising a base member supporting a receiving head comprising a receiving opening for receiving a portion of the nozzle to be cleaned, a gas inlet at the base member for receiving pressurized gas, a gas outlet at the receiving head for applying pressurized gas to the nozzle for flushing the nozzle, and at least one of a disposable discharge tube, a disposal collection vessel and a disposable filter element. Preferably, the cleaning apparatus comprises all three, a disposable discharge tube, a disposable collection vessel and a disposable filter element. It should be understood, that the cleaning apparatus according to the first aspect of the invention and the cleaning apparatus according to the second aspect of the invention comprise identical and similar preferred embodiments, which are in particular described in the dependent claims. Insofar, reference is made to the above description of the cleaning apparatus according to the first aspect of the invention.

In a third aspect of the invention, a maintenance set for a cleaning apparatus, in particular a cleaning apparatus as described in at least one of the aforementioned preferred embodiments of a cleaning apparatus according to the first or second aspect of the invention, comprising at least one of a disposable discharge tube, a disposable collection vessel and a disposable filter element is provided. The maintenance set preferably comprises all three, the disposable discharge tube, the disposable collection vessel and the disposable filter element. In particular, in combination with the cleaning device of the first or second aspect of the invention, the maintenance set provides its benefits. It helps to clean and maintain the cleaning apparatus. An operator simply needs to replace the disposable discharge tube, the disposable collection vessel and the disposable filter element, without the need of work intensive cleaning of single parts of the cleaning apparatus. Therefore, cycle times can be shortened and effective cleaning of the nozzle of the liquid dispensing device is possible.

For a more complete understanding of the invention, the invention will now be described in detail with reference to the accompanying drawings. The detailed description will illustrate and describe what is considered as a preferred embodiment of the invention. It should of course be understood that various modifications and changes in form or detail could readily be made without departing from the spirit of the invention. It is therefore intended that the invention may not be limited to the exact form and detail shown and described herein, nor to anything less than the whole of the invention disclosed herein and as claimed hereinafter. Further the features described in the description, the drawing and the claims disclosing the invention may be essential for further developments of the invention considered alone or in combination. In particular, any reference signs in the claims shall not be construed as limiting the scope of the invention. The wording "comprising" does not exclude other elements or steps. The wording "a" or "an" does not exclude a plurality. The wording, "a number of" items, comprises also the number one, i.e. a single item, and further numbers like two, three, four and so forth.

BRIEF DESCRIPTION OF THE DRAWINGS

In the accompanying drawings

DETAILED DESCRIPTION

Figure 1:
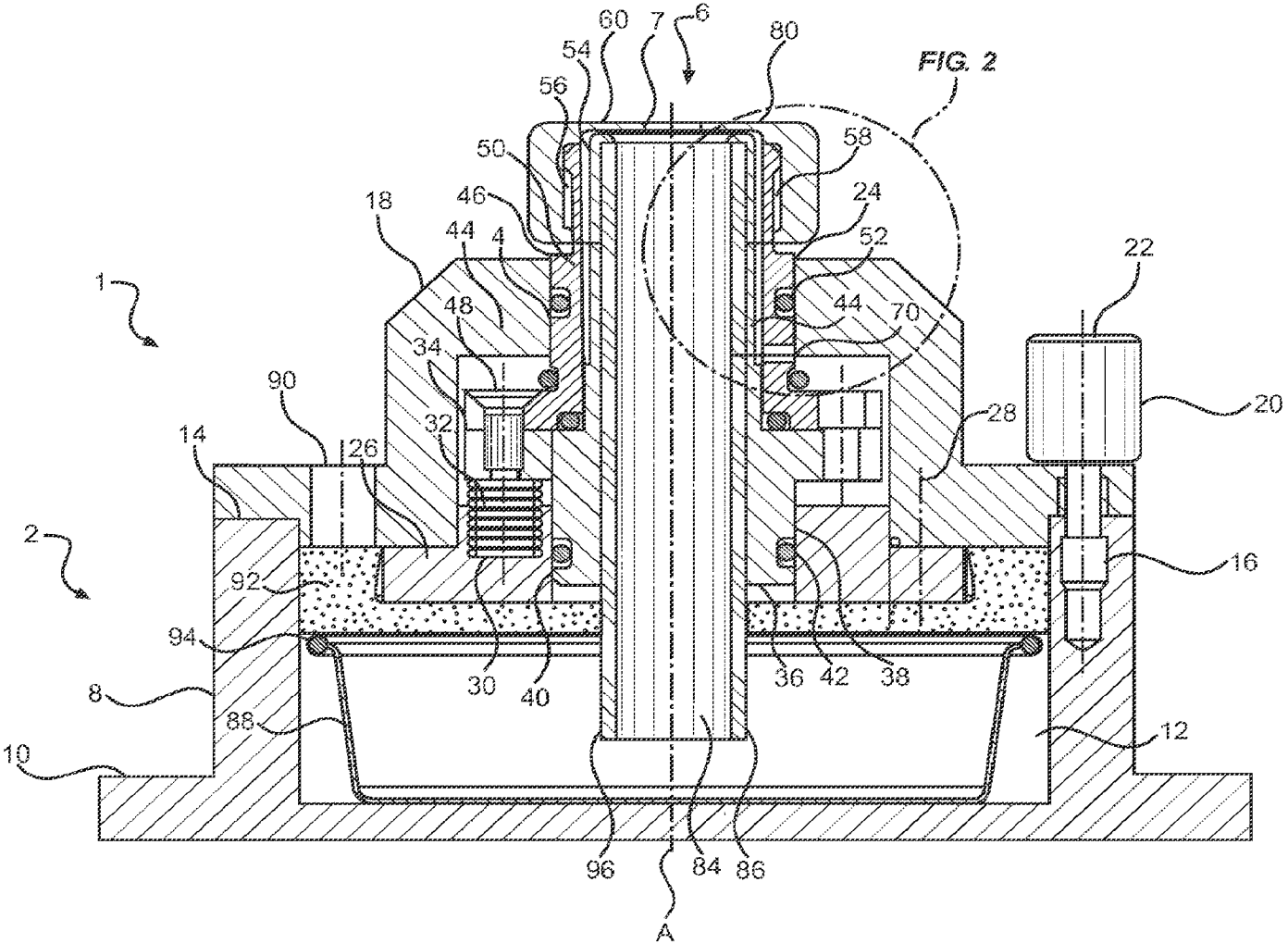
FIG. 1 shows a cross-sectional view of the cleaning apparatus.

A cleaning apparatus 1 (cf. FIG. 1) comprises a base member 2 and a receiving head 4. The receiving head 4 is supported in the base member 2 and comprises a receiving opening 6 for receiving a portion of a nozzle 102 to be cleaned (only shown in FIG. 5). The opening 6 is limited by a sealing edge 7.

Figure 3:
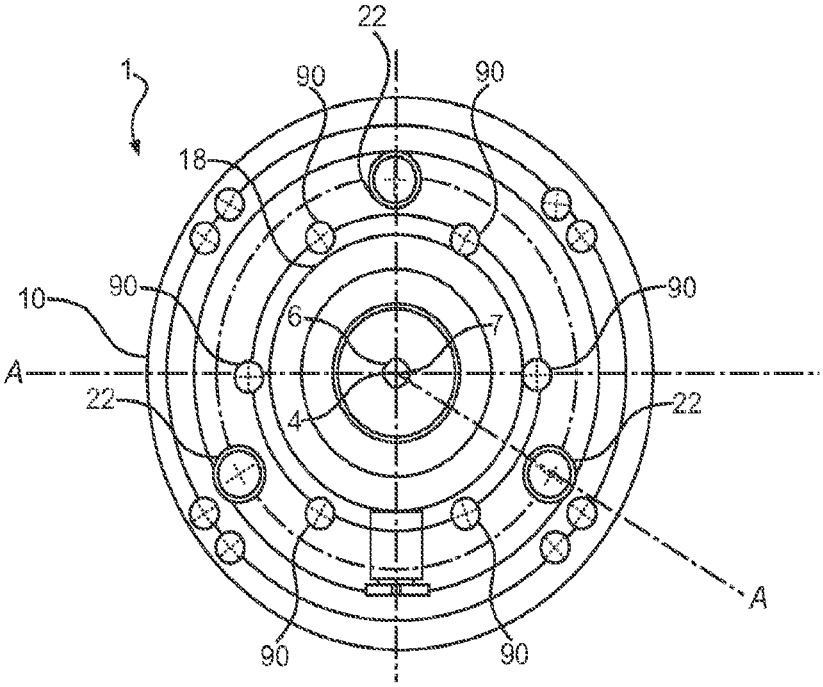
FIG. 3 shows a top view of the cleaning apparatus of FIG. 1.

The base member 2 comprises a lower portion 8 having a foot portion 10 by means of which the apparatus 1 may be located on a table, or a fixed to any other supporting structure. The lower portion 8 is substantially cup-shaped and defines a cavity 12 inside a circumferential wall 14. The wall 14 has a tubular shape and comprises screw threaded bores 16 (only one shown in FIG. 1; cf. also FIG. 3). The top surface of the wall 14 receives a head portion 18 of the base member 2. The head portion 18 is fixed to the base portion 8 by means of screws 20, which comprise an enlarged and knurled screw head 22, which can be gripped and screwed manually by an operator.

The head portion 18 comprises a central opening 24 around central axis A, in which the receiving head 4 is movably positioned. The base member 2 furthermore comprises an abutment collar 26 screwed against the head portion 18 by means of screws 28, for supporting the receiving head 4. The abutment collar 26 comprises recesses 30 (only one shown in FIG. 1), in which respective coiled springs 32 are placed, acting as biasing means for biasing the receiving head 4 into a first position P1 in which the receiving head 4 is in an upper position with respect to the base member 2 (cf. FIG. 4).

The coiled springs 32 act against a flange portion 34 of a first body part 36 of the receiving head 4. The first body part 36 comprises the flange portion 34 and an axial extension 38 seated in a through opening 40 of the support collar 26. An O-ring 42 is arranged between the axial extension 38 and inner circumferential surface of the through hole 40 for sealing the receiving member 4 against the base member 2. The first body part 36 comprises a tube portion 44 extending coaxially with axis A from the opposing side of the extension 36 toward the receiving opening 6 (see also FIG. 2).

The receiving head 4 furthermore comprises a second body part 46 which is screwed by means of at least one screw 48 against at the first body part 36. The second body part 46 comprises an axial extension 50 protruding through the opening 24 and sealed by means of an O-ring 52 against the opening 24. The extension 50 extends coaxially with the tube portion 44 and around the tube portion 44 and defines a cylindrical space 54 between the tube portion 44 and the extension 50. At an upper portion 56, the extension 50 comprises a screw threaded portion 58 receiving a nut 60 thereon which covers the cylindrical space 54 and defines the receiving opening 6 with the sealing edge 7.

Figure 2:
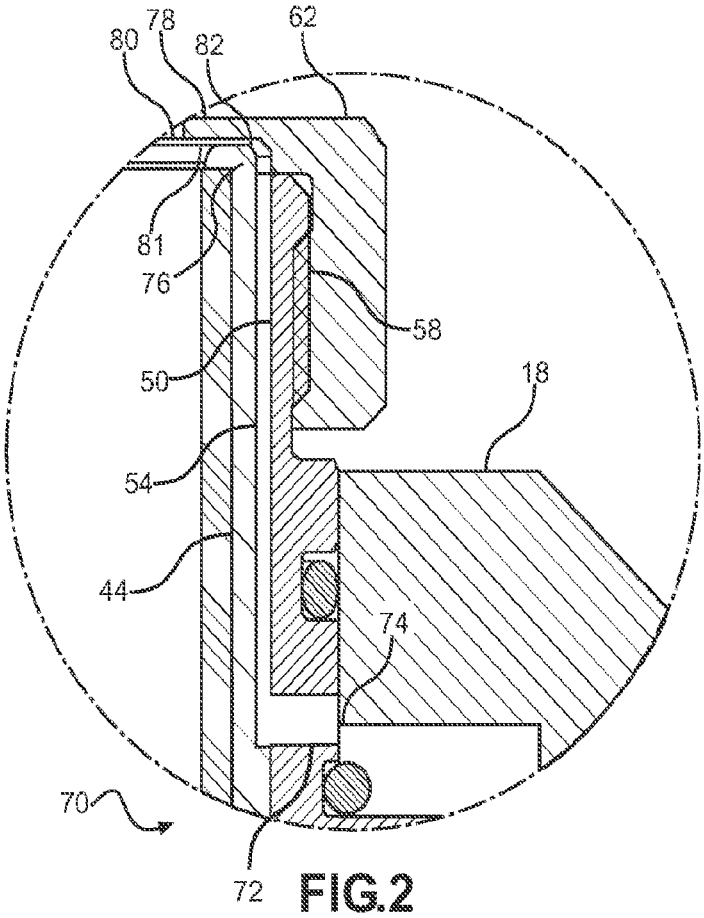
FIG. 2 shows a detail of FIG. 1.

The cleaning apparatus 1 comprises a shut-off valve 70. The shut-off valve 70 comprises according to this embodiment at least one radial extending conduit 72 and blocking portion 74. The conduit 72 is formed in the receiving head, in particular the second body part 46 of the receiving head 4 and connecting the cylindrical space 54 with the outside of the receiving head 4. The conduit 72 is blockable by means of a blocking portion 74 of the base member 2, in particular the head portion 58 (cf. FIG. 2). It shall be noted that a plurality of conduits 72 is provided circumferentially around the second body part 46, so that a cross section of the opened shut-off valve 70 is large enough to provide a sufficient gas flow. In FIGS. 1 and 2, the receiving head 4 is shown in intermediate position and the blocking portion 74 only extends in an upper half of conduit 72, with respect to FIG. 2. When the receiving head 4 is in the first position P1 (see FIG. 4) the conduit 72 is fully closed by means of the portion 74 and in a second position P2 in which the receiving head 4 is in a lower position and moved against the biasing force of the coiled springs 32 with respect to the base member 2 (see FIG. 5). In this second position P2, the conduit 72 is fully open. This will be described with respect to FIGS. 4 and 5 below.

Figure 5:
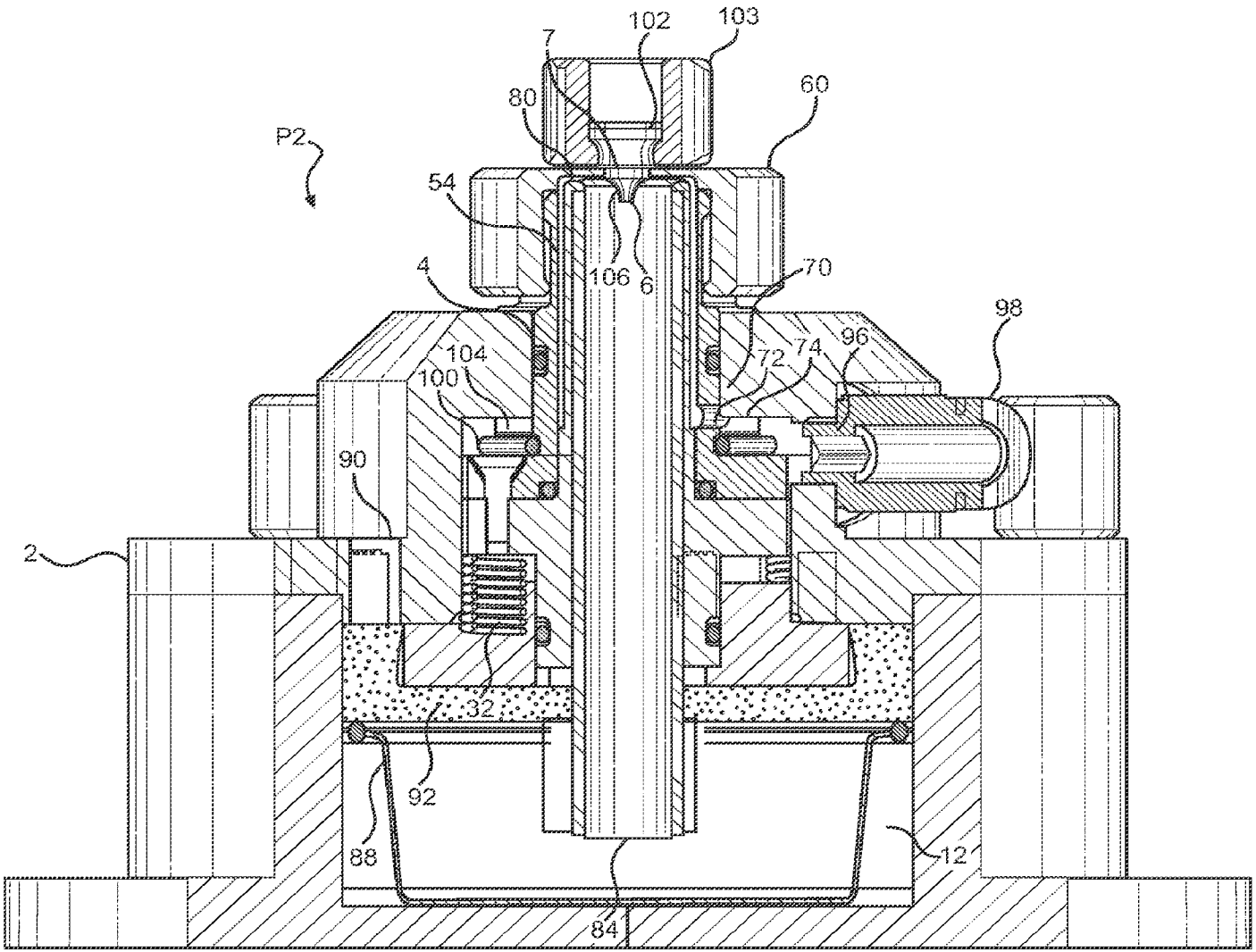
FIG. 5 shows the cleaning apparatus of FIG. 4, wherein the receiving head is in the second position.

An end portion 76 of the tube portion 44 and a lip portion 78 of the nut 60 together define a gas channel 80 for cleaning gas or purge gas for cleaning the nozzle 102 (FIG. 5). The channel 80 has an outlet 81 through which the gas can be dispensed towards the nozzle 102, when the nozzle 102 is received in the receiving opening 6. In this embodiment, the gas channel 80 has the shape of a ring (annulus) terminating in the circumferential outlet 81. In operation gas is being guided or projected radially and flows through gas channel 81 from the outside to the central axis A and thus to a nozzle 102 (see FIG. 5), which is received in the receiving opening 6. The lip portion 78 terminates in the sealing edge 7. While the lower surface of the lip 78 is substantially flat, the upper surface 82 of the portion 76 is tapered and thus the gas channel 80 flares open toward axis A. The gas channel 80 is thus formed according to a laval nozzle for providing a supersonic gas stream. At the neck portion the gas channel 80 has a cross sectional width of 0.3 mm.

The gas channel 80 and thus the outlet 81 is in gas communication with the cylindrical space 54, which is in gas communication with conduit 72. Therefore, when gas enters conduit 72 and subsequently enters the cylindrical space 54 and exits the receiving head 4 through the outlet 81, pressurized gas is applied to the nozzle 102 for flushing the nozzle 102.

The receiving opening 6 opens downward with respect to FIGS. 1 and 2 in a discharge channel 84. The discharge channel 84 runs from the receiving opening 6 to the cavity 12. The discharge channel 84 is defined circumferentially by the first body part 36 of the receiving head. According to this embodiment, the discharge channel 84 is lined by means of a discharge tube 86 which is received in the receiving head 4. The discharge tube 86 is formed as a disposable item and made out of a plastic material. The discharge tube 86 terminates within a collection vessel 88 which is cup-shaped and placed inside the cavity 12. Therefore, when a nozzle is received in the receiving opening 6 and flushed by means of gas exiting the gas channel 80, residual liquid is discharged through the discharge tube 86 and received in the collection vessel 88.

When the nozzle 102 is received in the opening 6 and the receiving head 4 is pushed downwards, the nozzle 102 contacts the sealing edge 7 and is pressed against it so as to seal the nozzle tip 106 against the environment (cf. FIG. 5). Thus, the cleaned off particles remain inside the apparatus 1, in particular in the discharge tube 86 and the vessel 88.

The cleaning apparatus furthermore comprises gas outlets 90 (one shown in FIG. 1; see FIG. 3) through which purge gas, which has travelled through the discharge channel 84 can exit the cleaning apparatus 1. The gas exits 90 are provided as bores in the head portion 18 and connecting the environment with the cavity 12. The openings 90 are provided with a filter element 92 which is seated on a rim 94 of the collection vessel and contacting the base member 2 at the head portion 18 and the support 26. The filter element 92 comprises a central through hole 96 through which the discharge tube 86 extends. The filter element 92 is formed as a disposable item. The openings 90 are evenly distributed about the base member 2 (cf. FIG. 3) so as to minimize a stream inside the vessel 88 and to use a maximum surface of the filter element 92. It is preferred that the openings 90 are additionally provided with sound absorbers.

For maintenance, the disposable items 86, 88 and 92, namely the discharge tube 86, the vessel 88 and the filter element 92 can be changed. For this operation, an operator needs to loosen the screws 20, which are manually operable, and demounting the head portion 18 in which the receiving head 4 is seated, from the lower portion 8. Subsequently, the discharge tube 86 can be pulled out of the discharge channel 84, the filter element 92 and the vessel 88 can be taken off and replaced by a new filter element 92 and a new vessel 88. After a new discharge tube 86 has been placed in the discharge channel 84, the device can be closed again by fixing the screws 20.

Figure 4:
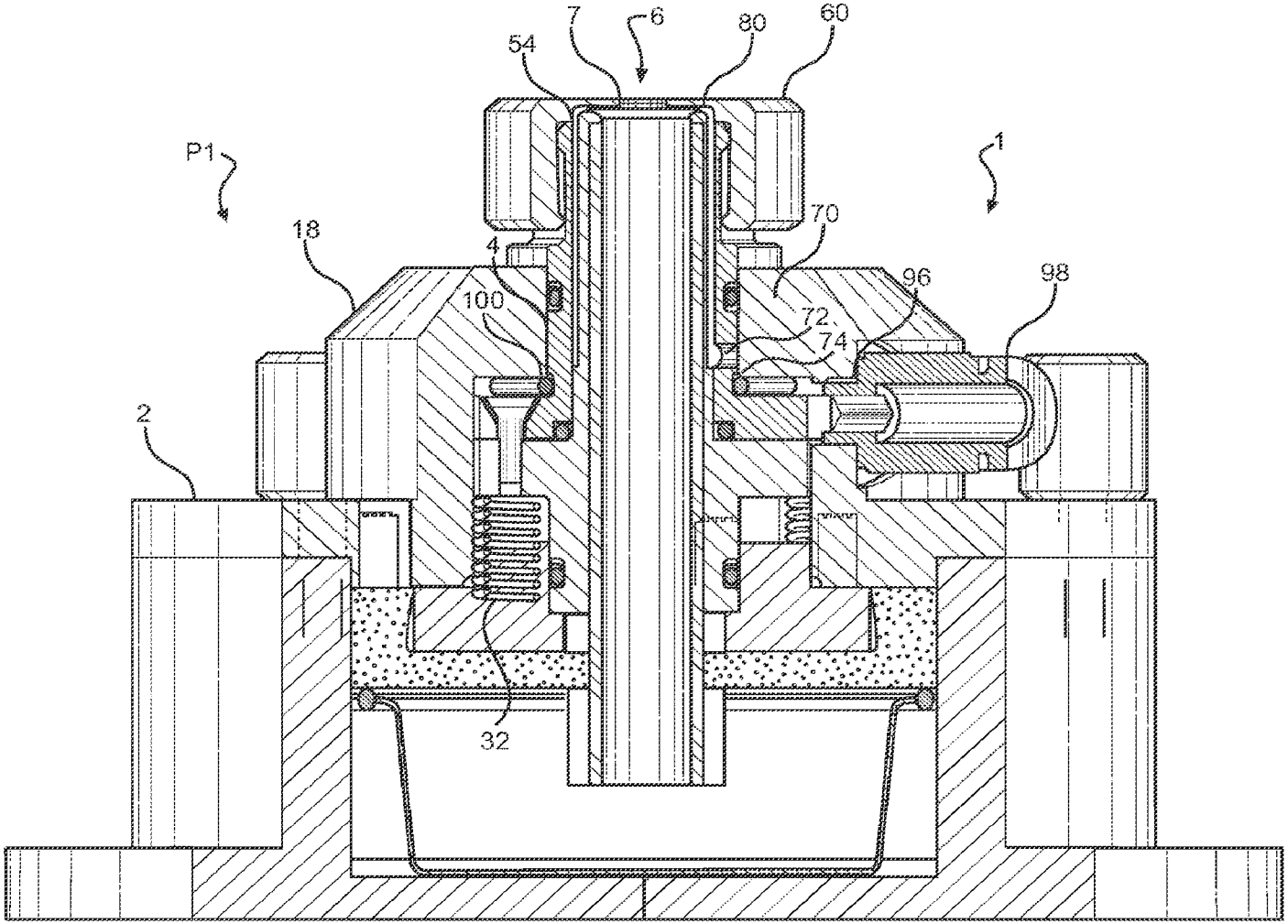
FIG. 4 shows the cleaning apparatus of FIG. 1 in another cross-sectional view, wherein the receiving head is in the first position.

Now, with respect to FIGS. 4 and 5, the actuation of the gas flow will be described.

The base member 2 comprises a gas inlet 96 in the head portion 18, provided with a connector 98 on which a hose of a high pressure net can be mounted. In FIG. 4, the receiving head 4 is shown in the first position P1, in which the receiving head 4 is in an upper position with respect to the base member 2 and the conduit 72 is fully closed by portion 74. Additionally, an O-ring 100 which is placed in a recess of the receiving head 4 is pushed against portion 74 for sealing the base member 2 against the receiving head 4. In this position, the coil springs 32 push the receiving head 4 into the first position P1 and no gas can flow from connector 98 to gas channel 80 and out of the outlet 81.

When subsequently a nozzle 102, which is fixed to a dispenser by means of a nut 103, is received in the receiving opening 6 and pushed downwards with respect to FIG. 5, the receiving head 4 is moved downwards into the second position P2, thus moving the conduit 70 with respect to portion 74. The O-ring 100 disengages portion 74 and a gap 104 is provided between O-ring and portion 74. At the same time, conduit 72 is unblocked from blocking portion 74 and gas can flow from connector 98 to gas inlet 96, through conduit 72 into the cylindrical space 54 and through gas channel 80 and out of the outlet 81 to flush the tip 106 of nozzle 102 and downwards through the discharge channel 84, through the cavity 12, through filter element 92 and out of gas outlets 90. Since the sealing edge 7 seals the discharge channel 84 against the nozzle 102, the gas discharged from gas channel 80 will only travel to nozzle 102 and downwards to the discharge channel 84 but not out of the receiving opening 6. In an embodiment the sealing edge 7 may be provided with an additional sealing element, such as a rubber ring or the like. Liquid residues at the nozzle tip 106 are being flushed by means of the gas exiting the gas channel 80 and discharged downward through discharge channel 84 into collection vessel 88. When the nozzle 102 is removed again, the coil springs 32 push the receiving head 4 again to the first position P1 (see FIG. 4) and the gas flow will be stopped again.

The invention claimed is:

1. A cleaning apparatus for cleaning a nozzle of a liquid dispensing device, the cleaning apparatus comprising:

a base member supporting a receiving head comprising a receiving opening for receiving a portion of the nozzle to be cleaned;

a gas inlet for receiving pressurized gas; and a gas channel having a gas outlet at the receiving head for applying pressurized gas to the nozzle for flushing the nozzle, wherein the receiving opening comprises a sealing edge for sealing the receiving head against the nozzle when the nozzle is received in the receiving opening, and wherein the gas outlet is adjacent the sealing edge, and wherein the gas channel is formed as a continuous circumferential slot around the receiving opening.

2. The cleaning apparatus of claim 1, wherein the receiving head is movable from a first position to a second position upon contact with the nozzle, and wherein upon movement of the receiving head from the first position into the second position, the gas inlet and the gas outlet are in gas communication for supplying gas from the gas inlet to the gas outlet.

3. The cleaning apparatus of claim 2, wherein the receiving head is moveable against a biasing force.

4. The cleaning apparatus of claim 3, further comprising biasing means for biasing the receiving head into the first position.

5. The cleaning apparatus of claim 4, wherein the biasing means comprise at least one coiled spring and/or at least one gas pressure cavity forming a pneumatic spring.

6. The cleaning apparatus of claim 2, further comprising a shut-off valve between the gas inlet and the gas outlet.

7. The cleaning apparatus of claim 6, wherein the shut-off valve is formed by a portion of the receiving head which blocks a gas conduit in the first position and unblocks the gas conduit in the second position.

8. The cleaning apparatus of claim 1, wherein the gas channel is formed such that the pressurized gas is applied in a substantially radial direction to the nozzle.

9. The cleaning apparatus of claim 1, wherein the gas channel is formed as a laval nozzle.

10. The cleaning apparatus of claim 1, wherein the gas channel has at least one tapered surface such that the gas channel flares open to the direction of the receiving opening.

11. The cleaning apparatus of claim 1, wherein the gas channel has a width of 1 mm or less.

12. The cleaning apparatus of claim 1, wherein the receiving head comprises a discharge channel for discharging cleaned off residual fluid.

13. The cleaning apparatus of claim 12, wherein a gas conduit leads to a substantially cylindrical space formed outside of the discharge channel and leading to the gas channel.

14. The cleaning apparatus of claim 13, wherein the cylindrical space is formed between first and second body parts of the receiving head which are fixed together.

15. The cleaning apparatus of claim 1, further comprising a removable nut defining the receiving opening with the sealing edge.

16. The cleaning apparatus of claim 12, wherein the discharge channel is provided with a discharge tube for lining an inner wall of the discharge channel.

17. The cleaning apparatus of claim 1, further comprising a collection vessel for collecting residual liquid cleaned from the nozzle.

18. The cleaning apparatus of claim 1, further comprising a second gas outlet for discharging gas which has been used to flush the nozzle, wherein the second gas outlet is provided with a filter element for filtering the used gas exiting the cleaning apparatus.

* * * * *